US012239206B2

(12) United States Patent
Fang et al.

(10) Patent No.: US 12,239,206 B2
(45) Date of Patent: Mar. 4, 2025

(54) PACKAGING TUBE

(71) Applicant: ZHEJIANG AXILONE SHUNHUA ALUMINUM & PLASTIC CO., LTD, Zhejiang (CN)

(72) Inventors: Yongqing Fang, Zhejiang (CN); Weifeng Zhu, Zhejiang (CN); Bokun Ni, Zhejiang (CN); Junjie Huang, Zhejiang (CN)

(73) Assignee: ZHEJIANG AXILONE SHUNHUA ALUMINUM & PLASTIC CO., LTD, Shaoxing (CN)

( * ) Notice: Subject to any disclaimer, the term of this patent is extended or adjusted under 35 U.S.C. 154(b) by 80 days.

(21) Appl. No.: 18/127,183

(22) Filed: Mar. 28, 2023

(65) Prior Publication Data

US 2023/0232963 A1 Jul. 27, 2023

Related U.S. Application Data

(63) Continuation of application No. PCT/CN2021/071037, filed on Jan. 11, 2021.

(30) Foreign Application Priority Data

Sep. 30, 2020 (CN) ..... 202011061476.8

(51) Int. Cl.
*A45D 40/06* (2006.01)
*A45D 40/20* (2006.01)

(52) U.S. Cl.
CPC ..... *A45D 40/06* (2013.01); *A45D 2040/204* (2013.01)

(58) Field of Classification Search
CPC ..... A45D 40/06; A45D 40/00; A45D 2040/0025; A45D 40/02; A45D 40/04;
(Continued)

(56) References Cited

U.S. PATENT DOCUMENTS 8,328,445 B2 * 12/2012 Martins ..... A45D 40/16 401/78
11,129,463 B2 * 9/2021 Dinata ..... A45D 40/12
(Continued)

FOREIGN PATENT DOCUMENTS

CN 108523378 A 9/2018
CN 108741578 A 11/2018
(Continued)

OTHER PUBLICATIONS

International Search Report of PCT Patent Application No. PCT/CN2021/071037 issued on Jul. 1, 2021.
(Continued)

*Primary Examiner* — David J Walczak

(57) ABSTRACT

A packaging tube includes a cartridge core and a base. The cartridge core and the base are both made of metal materials, the cartridge core has an axial direction in space, and the cartridge core includes a bead, a fork and a spiral in sequence from inside to outside. The inner wall of the spiral is provided with a thread structure, when the spiral rotates relative to the fork, the thread structure drives the bead to slide in the axial direction relative to the fork, an adaptation structure capable of being inserted and pulled in the axial direction is provided between the fork and the base, and the adaptation structure limits the relative movement of the fork and the base in the axial direction and in a circumferential direction.

20 Claims, 18 Drawing Sheets

(58) Field of Classification Search
CPC ..... A45D 2040/204; A45D 40/205; A45D 2040/208
USPC ..... 401/75–78
See application file for complete search history.

(56) References Cited

U.S. PATENT DOCUMENTS

| | | | | |
|---|---|---|---|---|
| 11,350,723 | B2 * | 6/2022 | Trochel | A45D 40/16 |
| 2010/0183355 | A1 | 7/2010 | Pires et al. | |

FOREIGN PATENT DOCUMENTS

| | | | |
|---|---|---|---|
| CN | 110801095 | A | 2/2020 |
| CN | 111743284 | A | 10/2020 |
| CN | 212368550 | U | 1/2021 |
| FR | 2923998 | A1 | 5/2009 |
| FR | 2923998 | B1 | 3/2010 |
| GB | 1298934 | A | 12/1972 |
| WO | 2022000610 | A1 | 1/2022 |

OTHER PUBLICATIONS

Extended European Search Report of European Patent Application No. 21873787.2 issued on Oct. 9, 2024.

* cited by examiner

PACKAGING TUBE

CROSS-REFERENCE TO RELATED APPLICATIONS

The present application is a Continuation Application of PCT Application No. PCT/CN2021/071037, filed on Jan. 11, 2021, which claims the priority of Chinese Application No. 202011061476.8, filed on Sep. 30, 2020, the entire contents of which are hereby incorporated by reference.

TECHNICAL FIELD

The present application relates to a packaging tube, in particular to a cosmetic packaging tube made of metal with a replaceable center tube core.

DESCRIPTION OF THE PRIOR ART

The lipstick tube generally consists of a top cover, a base and a center tube core. The base and the center tube core are fixedly connected with each other, and the top cover and the base are fitted with each other to form a cavity for receiving the center tube core. The center tube core generally consists of a center tube, a spiral, a prong and a bead.

Most of the components of the existing lipstick tubes are plastic parts, in order to facilitate the injection molding process to obtain a complex structure as well as the preceding design and subsequent assembly, and reduce the manufacturing cost. However, the plastic parts have the disadvantages of easy denaturation and weak corrosion resistance. After long-term use, some fitting structures of the lipstick tube becomes loose, resulting in problems such as unsmooth movement of the paste or loose snap fit of the top cover, which seriously affects the user experience and product stability. (At present, a plastic limit order is presented in the international community, and an all-aluminum packaging tube meets the future requirement for green development).

SUMMARY OF THE DISCLOSURE

The present application provides a cosmetic packaging tube made of metal with a replaceable center tube core.

A packaging tube, comprising a center tube core and a base, wherein the center tube core and the base are both made of metal, the center tube core has an axial direction and comprises a bead, a prong and a spiral arranged from interior to exterior in sequence, and wherein an inner wall of the spiral has a threaded structure which is configured to drive the bead to slide axially relative to the prong when the spiral rotates relative to the prong, and fitting structures that are pluggable one another in the axial direction are provided between the prong and the base for limiting relative movement between the prong and the base in the axial and circumferential directions.

The following further provides several alternatives, which are not used as additional limitations on the above-mentioned subject matter, but are only further additions or preferences. Without technical or logical contradiction, the alternatives can be combined the above-mentioned subject matter, independently or in combination.

Optionally, a bottom of the prong is provided with a socket, or the bottom of the prong is fixed with a connecting seat having the socket, and the base is provided with a plug fitting with the socket;

Both the socket and the plug, at least locally, have a non-circular cross-sectional shape to limit circumferential movement therebetween.

Optionally, the socket is a through hole or a blind hole.

Optionally, an inner wall of the socket extends in the axial direction to form a receiving sleeve for accommodating the plug.

Optionally, engagement portions of the socket and the plug have cross sections in shape of polygon.

Optionally, the polygon is a regular polygon with 4 to 8 sides.

Optionally, the socket has the same cross-sectional shape at all portions, which is adapted to the cross-sectional shape of the plug.

Optionally, engagement portions of the socket and the plug have an axial length no less than 3 mm.

Optionally, a top edge of the plug has a chamfered structure.

Optionally, the base comprises an outer base and an inner base located within the outer base, and wherein the inner base comprises a fixing plate and a columnar portion protruding axially from middle of the fixing plate and used as the plug.

Optionally, the fixing plate and the outer base are directly or indirectly fixed to each other, and the fixing method is selected from at least one of the following methods:

interference fit;

bonding;

welding; and snapping fit.

Optionally, the plug has a non-circular cross-sectional shape only at a portion adjacent to the fixing plate.

Optionally, an outer peripheral edge of the fixing plate is adjacent to an inner wall of the outer base.

Optionally, the outer peripheral edge of the fixing plate has a flange, and an outer peripheral edge of the flange abuts against the inner wall of the outer base.

Optionally, one of the prong and the base has a radially extending positioning portion, and the other has a positioning groove for receiving the positioning portion, and wherein the prong and the base restrict axial movement relative to each other through the positioning portion and the positioning groove that cooperate with each other.

Optionally, the positioning portion includes a plurality of positioning protrusions arranged at intervals or an annular positioning rib.

Optionally, the positioning portion protrudes outside an outer wall of the plug, and the positioning groove is opened in an inner wall of the socket.

Optionally, the base comprises an outer base and an inner base located within the outer base, the inner base comprises a fixing plate and a columnar portion protruding axially from middle of the fixing plate and used as the plug;

The edge portion of the fixing plate extends axially to form a skirt surrounding an outer periphery of the prong, wherein the positioning portion is located inside the skirt, and the positioning groove is opened in an outer wall of the prong.

Optionally, the skirt comprises a plurality of unit sheets arranged at intervals in the circumferential direction, and the positioning portion is provided on at least two of the unit sheets.

Optionally, the prong has a bottom opening which has an inner flange, and the connecting seat includes an annular portion overlapping the inner flange and a receiving sleeve extending axially from an inner edge of the annular portion into the bottom opening, and wherein an interior of the receiving sleeve is the socket.

Optionally, the annular portion has an axial undulating structure, and the base and the prong are abutted and pre-tensioned with each other through the undulating structure.

Optionally, the undulating structure includes a plurality of bulges arranged at intervals, and in the axial direction, the bulges protrude in the same direction and face the prong.

Optionally, the bulges are evenly distributed along the axial direction, and are positioned adjacent to the socket in a radial direction.

Optionally, the prong and the base are magnetically engaged to restrict mutual axial movement.

Optionally, the base comprises an outer base and an inner base located within the outer base, and the inner base comprises a fixing plate and a columnar portion protruding axially from middle of the fixing plate and used as the plug;

A first attracting member is clamped and fixed between the outer base and the inner base, and a second attracting member magnetically attracted to the first attracting member is fixed on the prong.

Optionally, an outer peripheral edge of the fixing plate has a flange facing away from the prong, and the first attracting member is enclosed in the flange.

Optionally, the second attracting member is ring-shaped and fixed around an outer periphery of the prong.

Optionally, the prong has a bottom opening which has an inner flange, and the connecting seat includes an annular portion overlapping the inner flange and a receiving sleeve extending axially from an inner edge of the annular portion into the bottom opening, and wherein an interior of the receiving sleeve is the socket;

The bottom of the second attracting member is provided with an inwardly folded portion, and the inwardly folded portion is fixedly clamped between the inner flange and the annular portion.

Optionally, a top edge of the receiving sleeve is rolled up and wraps an inner edge of the inner flange.

The bottom of the spiral covers an outer periphery of the second attracting member.

Optionally, bottom edge of the spiral abuts the annular portion;

The annular portion, the spiral and the prong enclose the second attracting member.

Optionally, the outer base is a cylindrical structure, one end of which is closed or contracted, and the other end has a receiving opening for plugging and unplugging of the center tube core.

Optionally, the base further includes a sleeve fixedly inserted into the receiving opening, an outer periphery of the sleeve has an annular positioning shoulder, one axial side of which abuts against a top edge of the receiving opening, and the other axial side is located outside the base and serves as a connecting portion.

Optionally, the packaging tube further includes a cover that is movably inserted into the connecting portion, and the cover and the base enclose the center tube core.

Optionally, a side wall of the prong is provided with a slideway extending in the axial direction, and the bead has a guiding portion passing through the slideway in a radial direction, and wherein the guiding portion matches with the threaded structure.

Optionally, two ends of the slideway have recessed positioning areas, and when the bead slides to limit position, the guiding portions are respectively located within the positioning areas at the corresponding ends.

The components of the packaging tube of the present application are all made of metal. The special structural strength and high processing precision of the metal improve the movement stability and the overall quality of the packaging tube.

Figure 1:
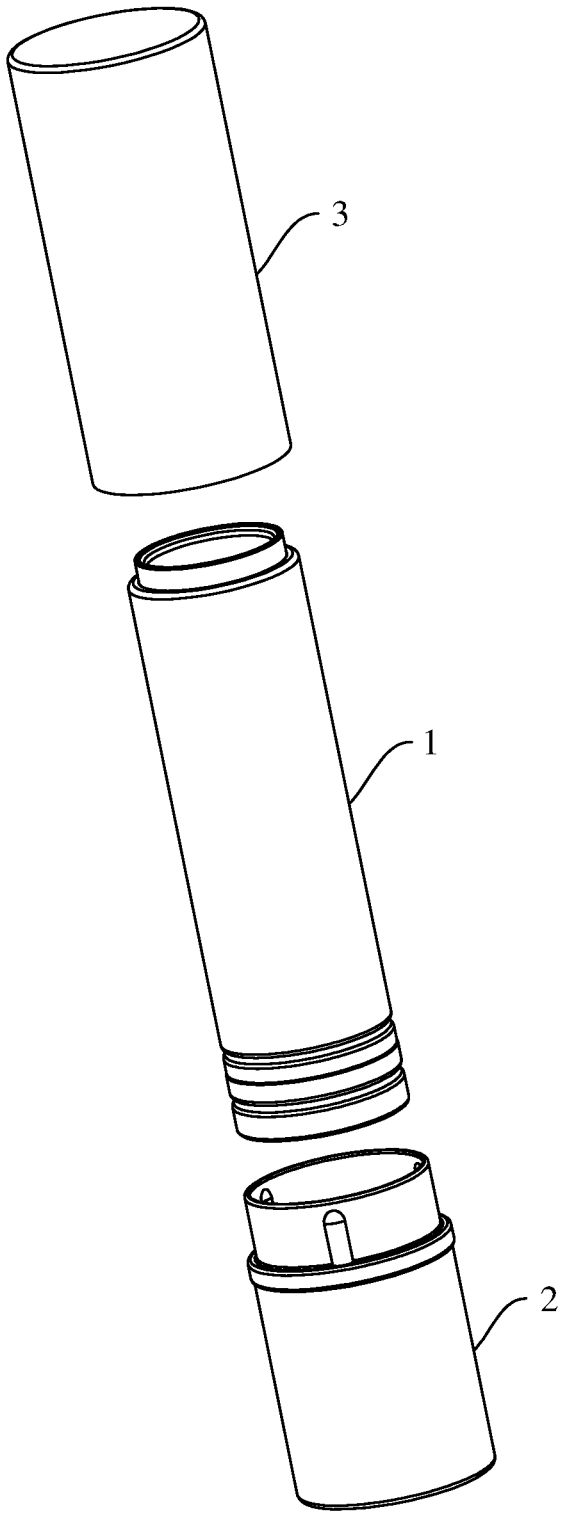
FIG. 1 is an exploded view of a packaging tube according to an embodiment.

The reference signs in the drawings are listed as follows:

1. center tube core; 10. spiral; 100. threaded structure;

11. prong; 110. socket; 111. receiving sleeve; 112. slideway; 113. positioning area;

12. bead; 120. guiding portion;

13. connecting seat; 14. positioning portion; 15. positioning groove; 16. receiving opening;

17. sleeve; 170. positioning shoulder; 171. connecting portion; 172. extending portion;

2. base; 20. outer base; 21. inner base; 210. plug; 211. fixing plate;

40. bottom opening; 41. inner flange; 42. annular portion; 43. bulge;

50, skirt; 60, first attracting member; 61, second attracting member; 62, flange; 611, inwardly folded portion; 64, inner edge;

3. cover.

DESCRIPTION OF EMBODIMENTS

The technical solutions according to the embodiments of the present application will be described in combination with the drawings according to the embodiments of the present application. The described embodiments represent some but not all the possible embodiments. Based on the embodiments in this application, all other embodiments obtained by the skilled person in the art without creative efforts fall in the protection scope of this application.

It should be noted that, when a component is "connected" with another component, it may be directly connected to another component or may be indirectly connected to another component through a further component. When a component is "provided" on another component, it may be directly provided on another component or may be provided on another component through a further component.

Unless otherwise defined, all technical and scientific terms used herein have the same meaning as commonly understood by the skilled person in the art. The terms in the description of the present application are used to describe specific embodiments, and not to limit the present application. The term "and/or" used herein includes any combinations of one or more of the listed options, as well as the combination of all of the listed options.

In the present application, the terms "first", "second" and so on are only used for descriptive purposes, and should not be understood as indicating or implying the relative importance or implicitly indicating the quantity and order of the indicated technical features. Thus, a feature defined with "first" and "second" may explicitly or implicitly includes one or more of such features. In the description of the present application, "plurality" means at least two, such as two, three, etc., unless otherwise specifically defined.

Unless otherwise specified, the axial direction is the axial direction of the center tube core 1, and the horizontal direction is perpendicular to the axial direction.

Referring to FIG. 2, FIG. 3, FIG. 10, FIG. 11, FIG. 18, and FIG. 19, some embodiments provide a packaging tube, including a center tube core 1 and a base 2, both of which are made of metal. The center tube core 1 has an axial direction, and includes a bead 12, a prong 11 and a spiral 10 arranged from the inside to the outside in sequence. The inner wall of the spiral 10 has a threaded structure 100, and when the spiral 10 rotates relative to the prong 11, the threaded structure 100 drives the bead 12 to slide axially relative to the prong 11. A fitting structure is provided between the prong 11 and the base 2 that is snap-fit in the axial direction and can restrict the relative movement between the prong 11 and the base 2 in the axial direction and in the circumferential direction.

The base 2, the bead 12, the prong 11 and the spiral 10 are all cylindrical structures. The base 2 is made of metal by punching (the metal material can be selected from aluminum, aluminum alloy among others, preferably materials that is corrosion-resistant and easy to cold-work) and has sufficient strength and corrosion resistance, can improve the impact resistance, protect the internal structure, and improve the product quality. The bead 12 is used to hold lipstick paste or medicinal paste, and is connected with the threaded structure 100. Both the spiral 10 and the prong 11 are made of metal, which is not easily deformed, and improves the rotation stability of the spiral 10 relative to the prong 11.

The prong 11 can be pulled out or inserted in the axial direction relative to the base 2, so that the entire center tube core 1 can be replaced and the base 2 and the cover 3 can be reused.

The threaded structure 100 includes grooves or protrusions helically arranged along the inner wall of the spiral, which cooperates with the bead 12 and drives the bead 12 to move axially. The threaded structure 100 can be obtained by punching or cutting. Compared with the existing packaging tubes, the center tube is omitted, which is convenient for assembly. Since the spiral 10 and the bead 12 are both made of metal, which is not easy to be deformed, the strength of the fitting structure between them is high. Further, the threaded structure 100 made of metal has a higher precision than that made of plastic material, which improves the stability of the bead 12 sliding along the threaded structure 100.

The fitting structure includes a protrusion arranged on one of the prong 11 and the base 2, and a groove arranged on the other which is matched with the protrusion. Due to the fitting structure, the prong 11 is not easy to come out of the base 2, avoiding the unintended falling of the center tube core 1, and the fitting structure can also limit the circumferential movement or radial offset of the prong 11 relative to the base 2, and prevent the prong 11 from synchronously rotating with the spiral 10. The prong 11 and the base 2 made of metal, which is not easily deformed, prevent the fitting structure from fail over time, causing the center tube core 1 to fall off easily.

Compared with plastic materials, it is easier for the parts made of metal to obtain higher processing precision here, and the user experience is better when the parts are moved relative to each other. The parts made of metal can be recycled and reused and more environmentally friendly.

Figure 2:
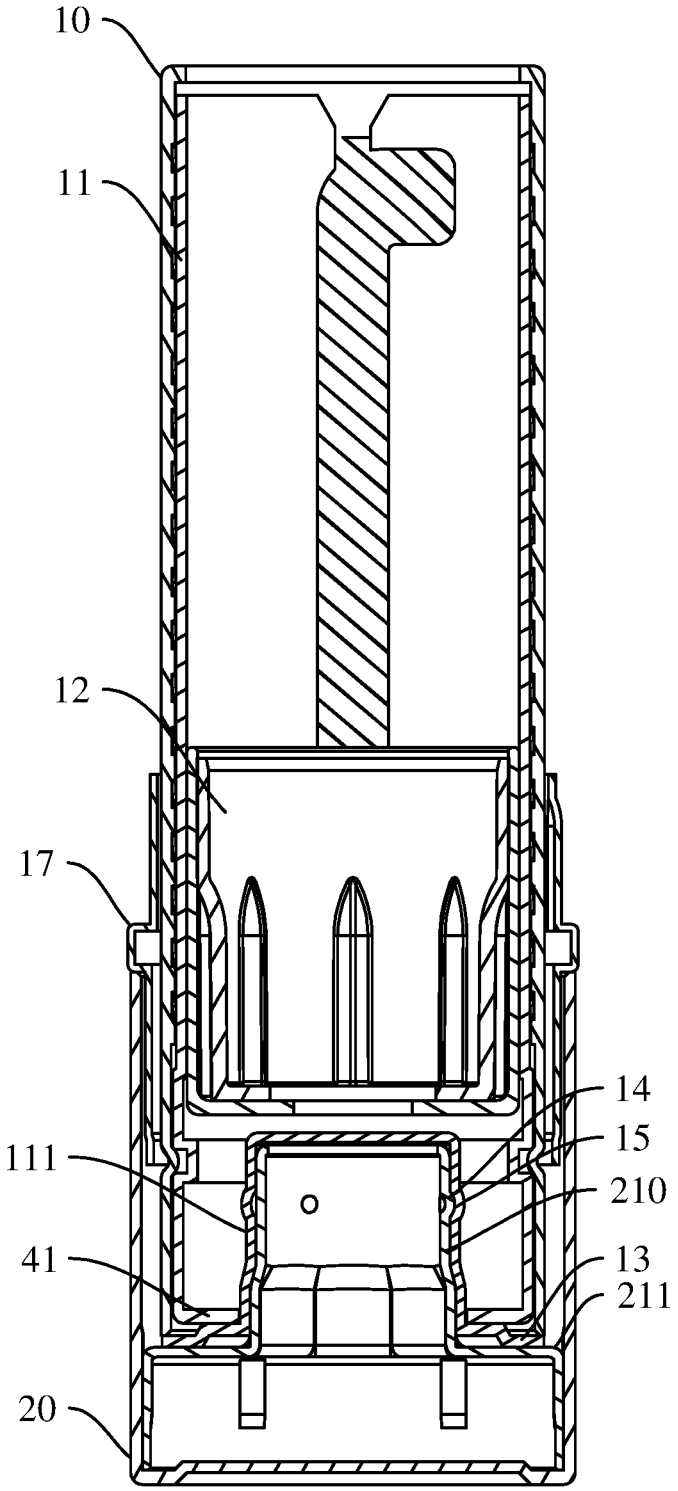
FIG. 2 is a structural schematic view of a packaging tube according to an embodiment.
Figure 3:
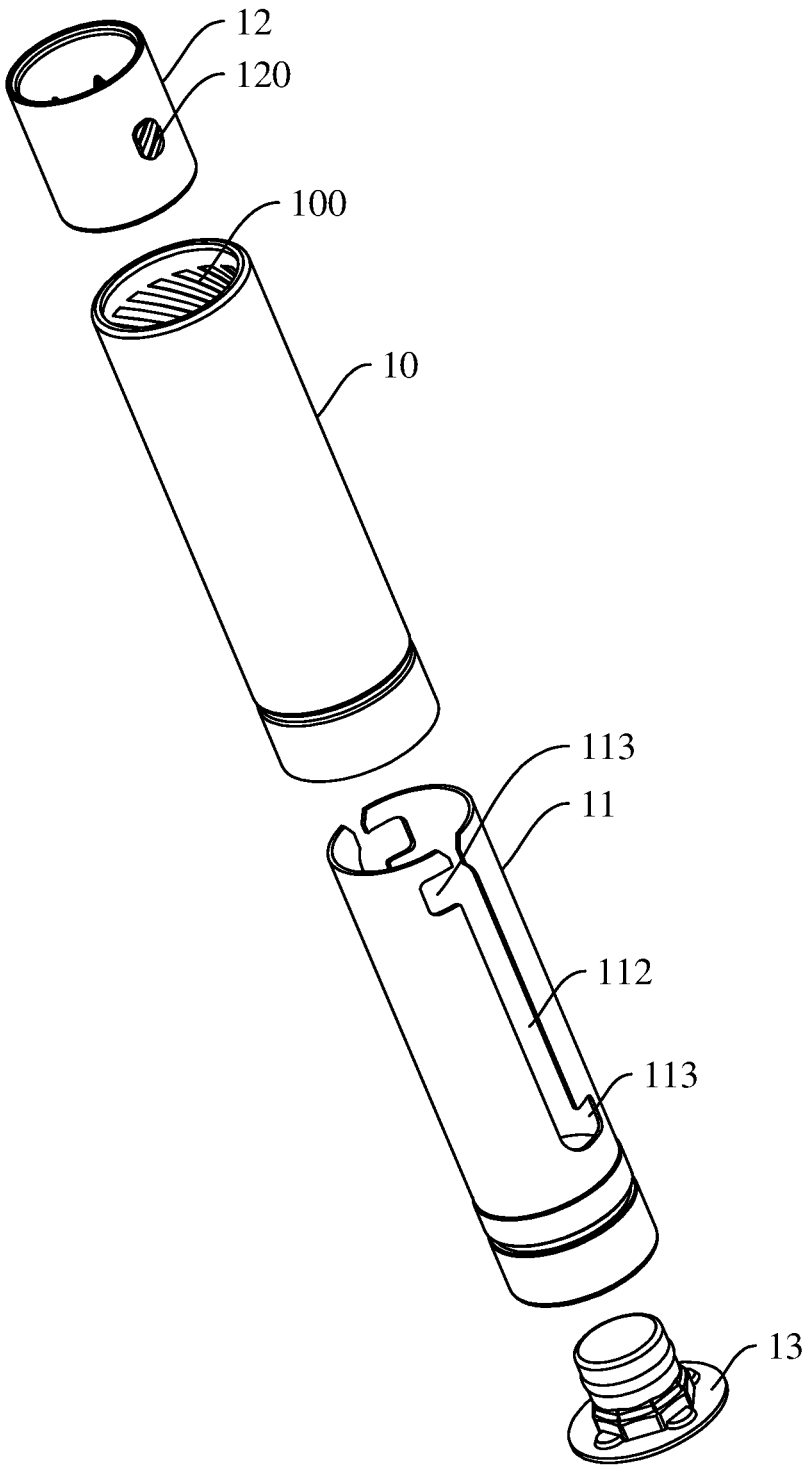
FIG. 3 is an exploded view of a center tube core according to an embodiment.
Figure 4:
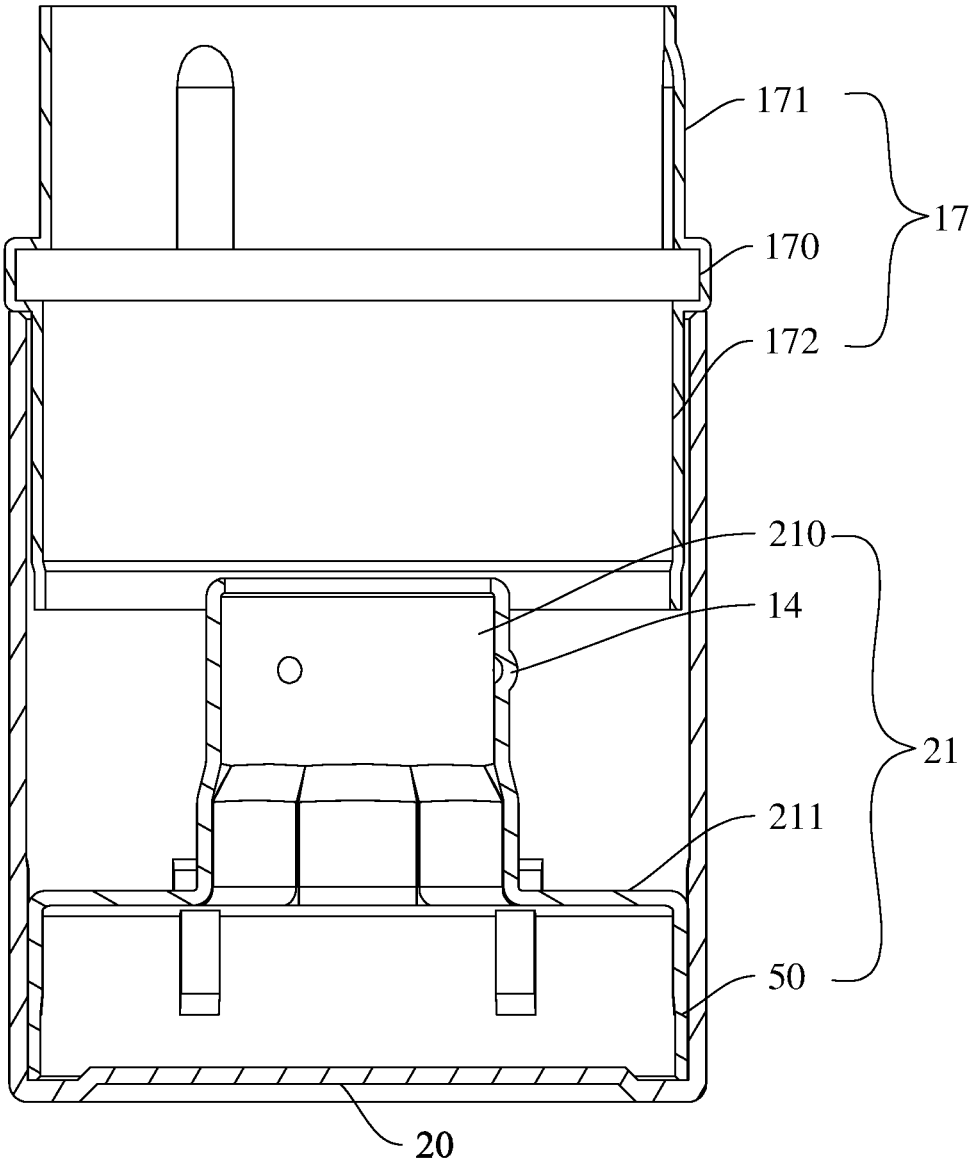
FIG. 4 is a structural schematic view of a base according to an embodiment.
Figure 11:
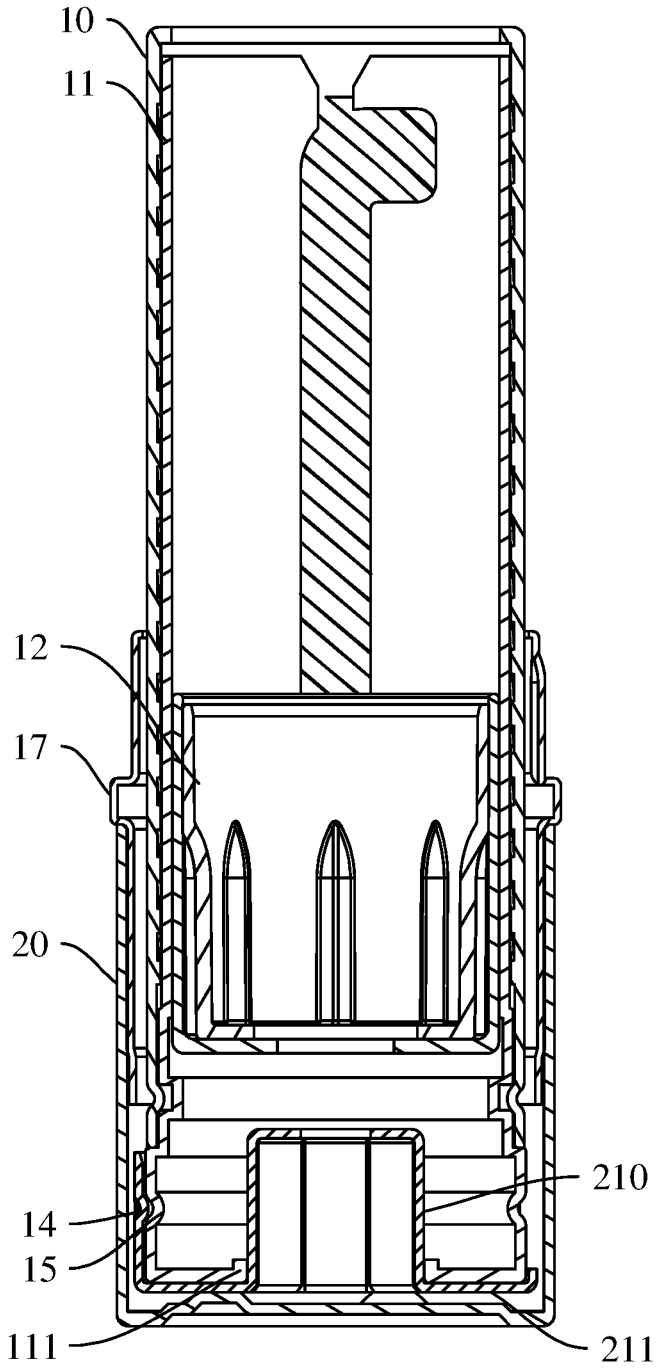
FIG. 11 is a structural schematic view of a packaging tube according to another embodiment.
Figure 12:
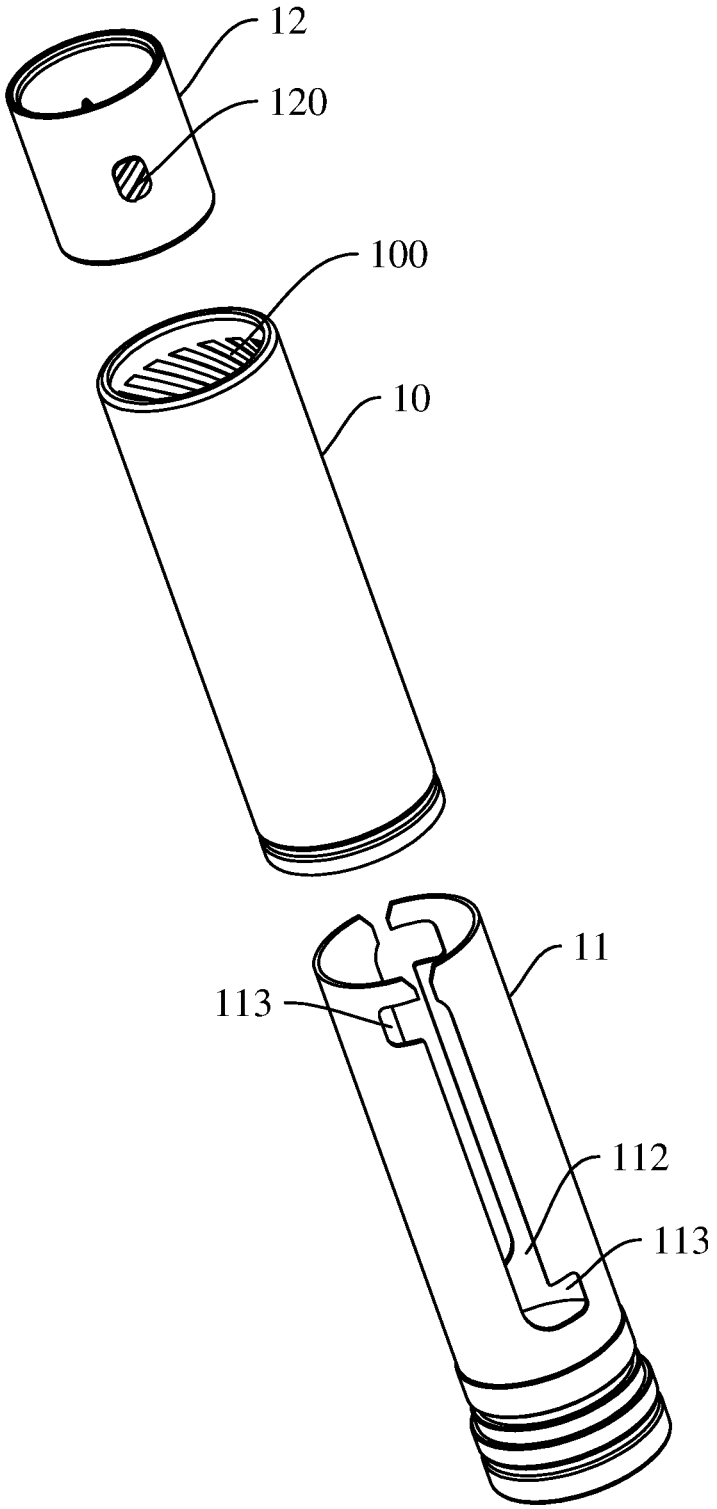
FIG. 12 is an exploded view of a center tube core according to an embodiment.
Figure 13:
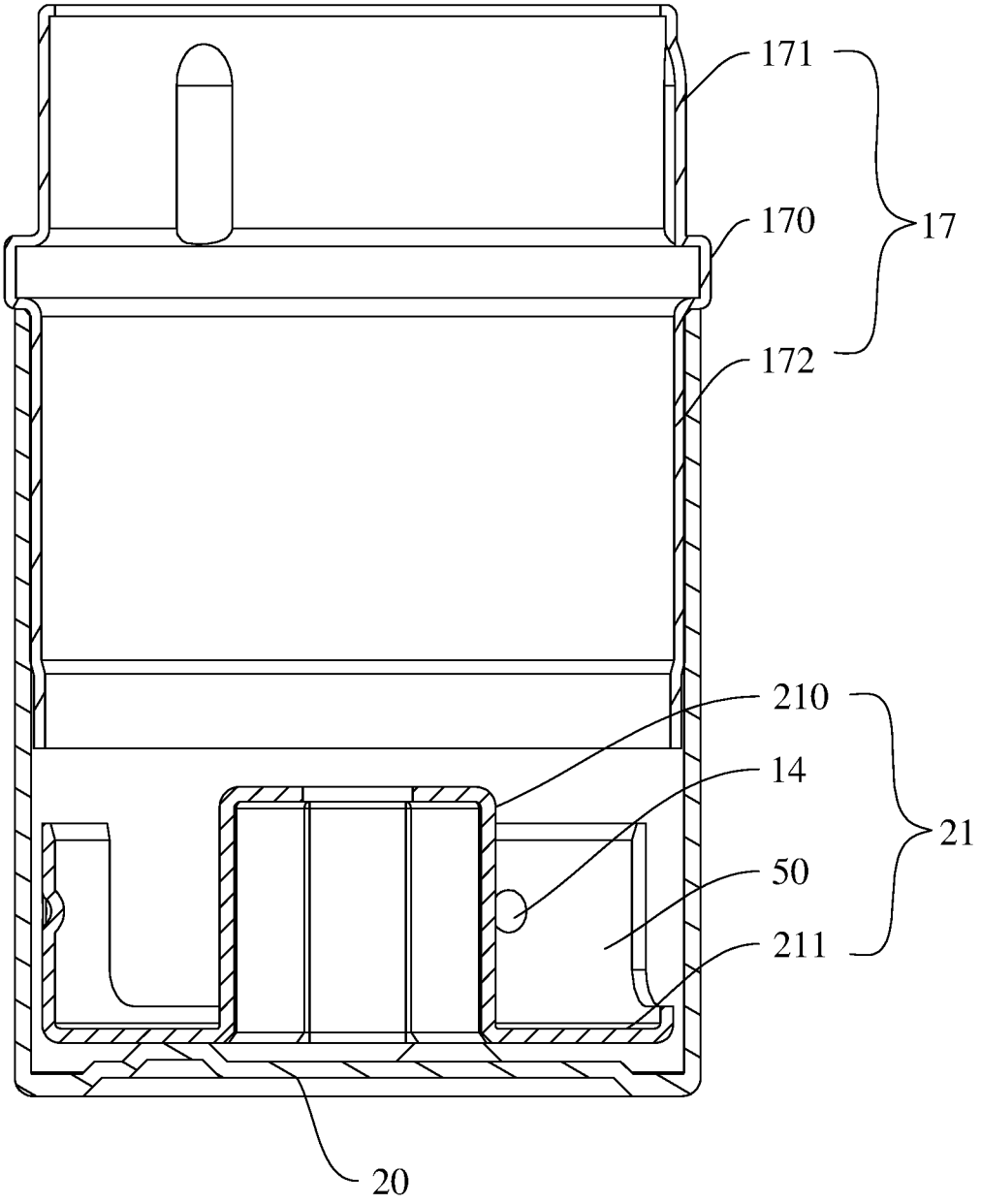
FIG. 13 is a structural schematic view of a base according to an embodiment.
Figure 18:
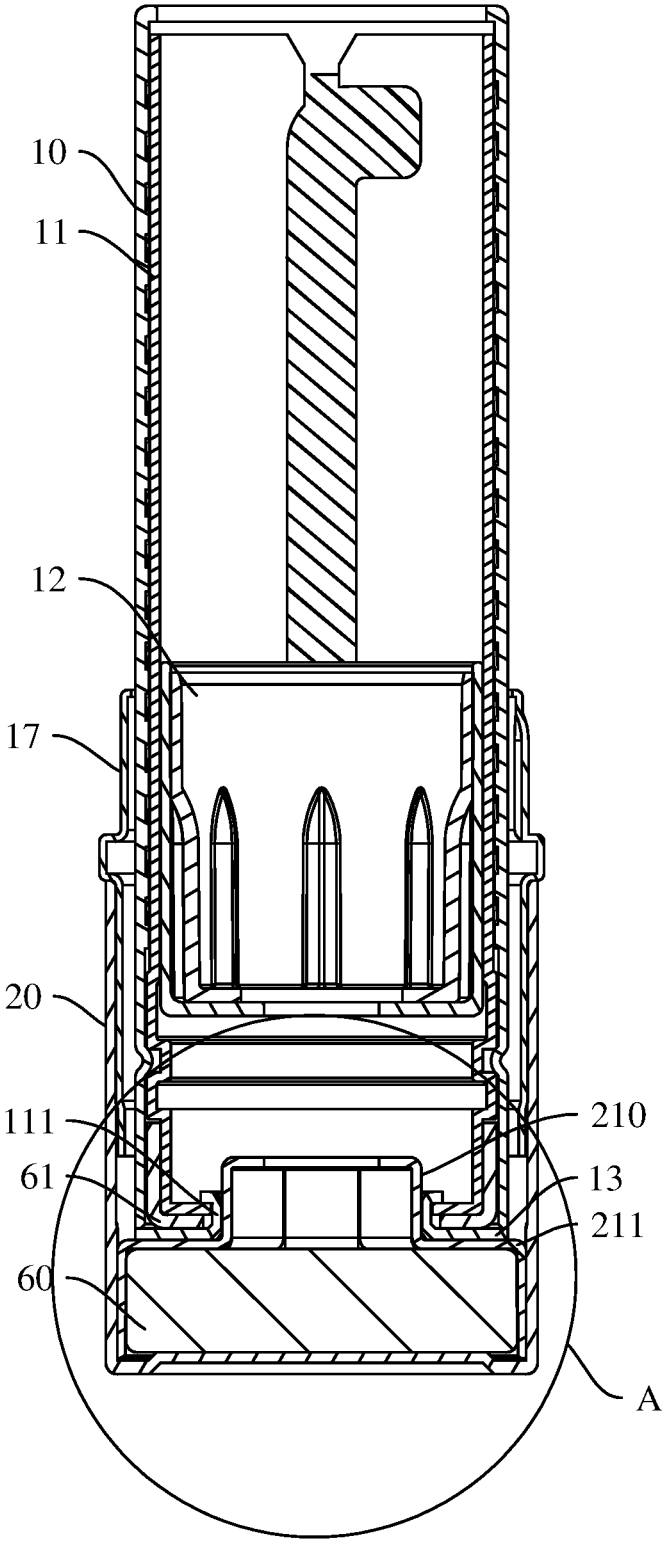
FIG. 18 is a structural schematic view of a packaging tube according to another embodiment.
Figure 19:
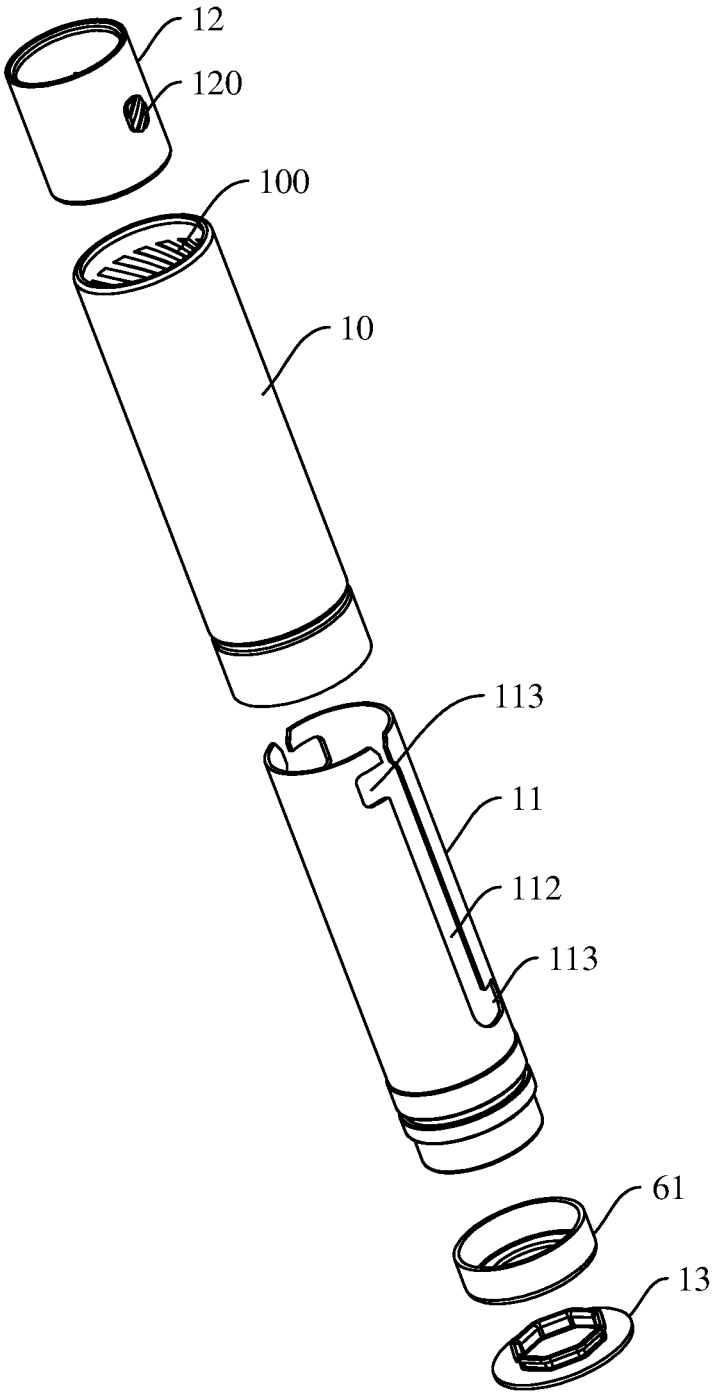
FIG. 19 is an exploded view of a center tube core according to an embodiment.

As shown in FIG. 2, FIG. 11 and FIG. 18, in some embodiments, the bottom of the prong 11 is provided with a socket 110, or the bottom of the prong 11 is fixed with a connecting seat 13 with a socket 110, and the base 2 is provided with a plug 210 engaging with the socket 110. Both the socket 110 and the plug 210, at least locally, have a non-circular shape in cross section, to limit a circumferential movement relative to each other.

Figure 7:
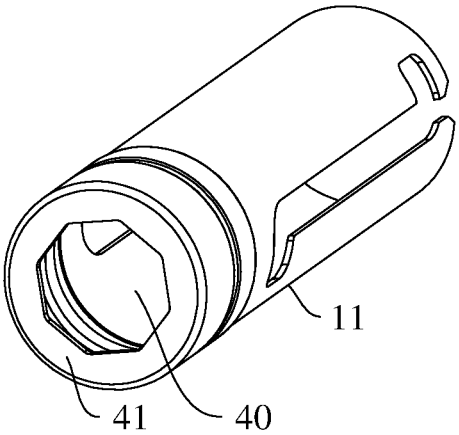
FIG. 7 is a perspective view of a prong according to an embodiment.
Figure 8:
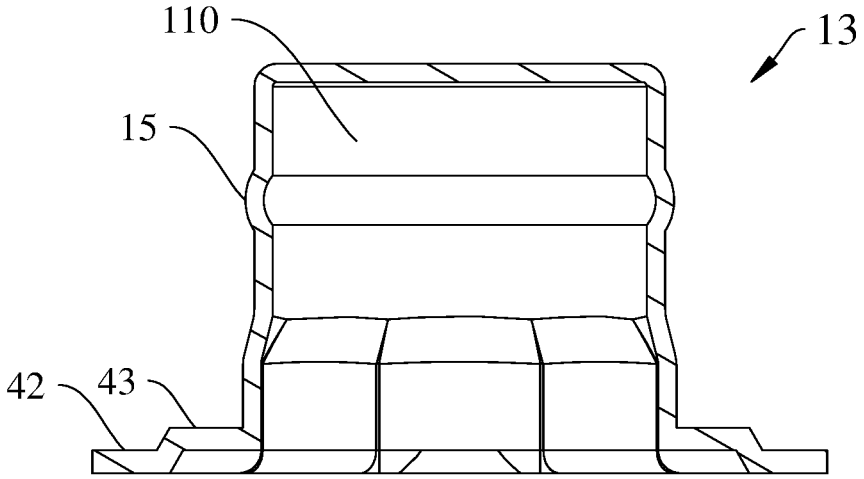
FIG. 8 is a cross-sectional view of a connecting seat according to an embodiment.
Figure 16:
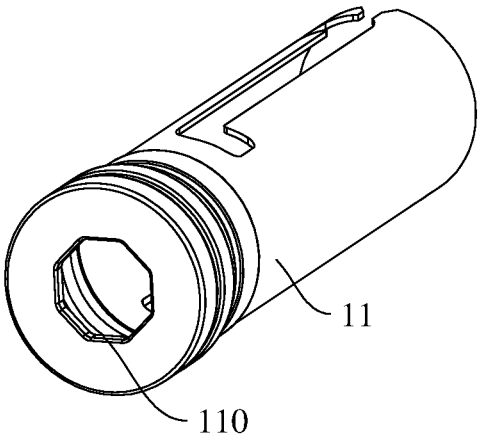
FIG. 16 is a perspective view of a prong according to an embodiment.

The socket 110 can be formed by punching or opening the prong 11 (refer to FIG. 16), and can limit the circumferential movement of the prong 11 relative to the base 2 by its structure, which saves parts and facilitates assembly. Alternatively, the socket 110 can be provided by a separate component (the connecting seat 13). The connecting seat 13 is cylindrical and connects the prong 11 and the base 2 based on the engagement of the socket 110 with the plug 210 (referring to FIG. 7, FIG. 23 and FIG. 24). Moreover, since both the connecting seat 13 and the prong 11 are made of metal, and no matter which assembly method is used, the engagement strength between the socket 110 and the plug 210 is improved.

The plug 210 can be a separate component, or can be formed by punching the base 2. The socket 110 and the plug 210 are snap-fitted, and since the horizontal cross-sections of the two are non-circular and closely fitted with each other, the circumferential movement relative to each other is limited.

Since the prong 11 or the connecting seat 13 is a metal piece, in some embodiments, the socket 110 is a through hole or a blind hole, which are both convenient for processing.

As shown in FIG. 2, FIG. 11 and FIG. 18, in some embodiments, a receiving sleeve 111 is provided at the inner wall of the socket 110 for accommodating the plug 210 and extends along the axial direction, which increases the contact area with the outer wall of the plug 210 and improves the engagement strength between the socket 110 and the plug 210, further restricting the circumferential movement of the prong 11 relative to the base 2 and also preventing wiggle, and guiding the prong 11 in the axial direction when installing the prong 11 and facilitating the plugging and unplugging operation of the center tube core 1 relative to the base 2.

In some embodiments, the engagement portions of the socket 110 and the plug 210 have a polygonal cross-sectional shape, which restricts the circumferential movement of the prong 11 relative to the base 2 from multiple angles, with a good movement restriction effect.

Since the prong 11 or the connecting seat 13 is a metal piece, in a preferred embodiment, the polygonal shape is a regular polygonal shape, which is easy for metal punching or drilling. Moreover, the number of sides of the polygon ranges from 4 to 8, with a good restricting effect for the circumferential movement of the prong 11 relative to the base 2, and the engagement of polygons improves the connection stability between the prong 11 and the base 2.

In some embodiments, the socket 110 has the same cross-sectional shape at all portions, which is adapted to the cross-sectional shape of the plug 210. All cross-sections along the axial length of the engagement portions of the socket 110 and the plug 210 are polygonal, which further restricts the circumferential movement of the prong 11 relative to the base 2.

In some embodiments, the axial length of the engagement portions of the socket 110 and the plug 210 is not less than 3 mm. Engagement portions with a sufficient length can improve the anti-wiggle effect and can be kept stably in position, and further prevents a suddenly falling off in a disassemble process by providing a buffer space for releasing the engagement.

In some embodiments, the top edge of the plug 210 has a chamfered structure. Since the socket 110 is vertically inserted around the plug 210, the chamfered structure facilitates the insertion and assembly of the socket 110 and the plug 210.

As shown in FIGS. 2 to 10, in some embodiments, the base 2 includes an outer base 20 and an inner base 21 located in the outer base. The inner base 21 includes a fixing plate 211 and a columnar portion protruding axially from the middle of the fixing plate 211, and the columnar portion is used as the plug 210.

The outer base 20 is cylindrical, made of metal material, and is formed by punching, and the interior thereof is recessed for receiving the inner base 21. The inner base 21 is used to support the center tube core 1 and is relatively fixedly connected with the center tube core 1. The fixing plate 211 is disc-shaped, but not strictly limited to a circular disc and the thickness thereof is not strictly limited either. The fixing plate 211 is fixedly connected in the outer base 20 for supporting the prong 11 or the connecting seat 13. The columnar portion is formed by punching the fixing plate 211 and forms a closed plane at the top to improve the structural strength of the plug 210.

If the connection between the fixing plate 211 and the outer base 20 is unstable, the center tube core 1 would be easily loosed. In some embodiments, the fixing plate 211 and the outer base 20 are directly or indirectly fixed to each other, and the fixing method is selected from at least one of the following methods:

Interference fitting, in which the edge of the fixing plate 211 and the inner wall of the outer base 20 are assembled in an interference fit;

Bonding, in which the bottom or edge of the fixing plate 211 is glued and then installed in the outer base 20, and after the glue is cured, the fixing plate 211 and the outer base 20 are connected and fixed with each other;

Welding, in which since both the fixing plate 211 and the outer base 20 are made of metal, welding can be used to fix the fixing plate 211 and the outer base 20 to each other;

Snap-fitting, in which one of the fixing plate 211 or the outer base 20 is provided with a snap, and the other is provided with a slot cooperating with the snap, and the two are fixed by snap-fitting with each other.

Compared with plastic materials, metal materials are adapted to more connecting methods, which is conducive to design and manufacture.

In some embodiments, the plug 210 has a non-circular cross section only at a portion adjacent to the fixing plate 211.

Since the length of the plug 210 in the axial direction is relatively long, in order to avoid excessive frictional force during assembly, a polygonal cross section is defined at a portion adjacent to the fixing plate 211, and a circular cross section is defined at a portion away from the fixing plate 211, the diameter of the circular cross section is smaller than the diameter of the circumference of the polygonal cross-section, so that the plug 210 and the socket 110 can be assembled easily.

In some embodiments, the outer peripheral edge of the fixing plate 211 is adjacent to the inner wall of the outer base 20, and the fixing plate 211 and the outer base 20 are in an interference fit or clearance fit and bonded with glue, which facilitates the installation of the fixing plate 211, with enough bonding or welding gap. Due to this configuration of being adjacent to each other, the center of the plug is close to the center of the outer base 20, which facilitates the plugging and unplugging operation of the center tube core 1.

In some embodiments, the outer peripheral edge of the fixing plate 211 has a flange, and the outer peripheral edge of the flange abuts against the inner wall of the outer base 20. The flange is formed by punching, and is used for guiding the fixing plate 211 when installing the fixing plate 211, which is conducive to installation. Further, the flange increases the area for gluing with the inner wall of the outer base 20, so that the connection of the fixing plate 211 is more secure.

In some embodiments, one of the prong 11 and the base 2 has a radially extending positioning portion 14, and the other has a positioning groove 15 for receiving the positioning portion 14, and the two restrict the axial movement to each other through the engagement between the positioning portion 14 and the positioning groove 15.

The positioning portion 14 and the positioning groove 15 are formed by punching the prong 11 or the base 2. The axial cross section of the positioning portion 14 can be polygonal or arc-shaped, and the extension distance thereof should not be too long, so as not to affect the installation and the plugging and unplugging operation of the center tube core 1. Due to the engagement of the positioning portion 14 with the positioning groove 15, the prong 11 can be prevented from falling off the base 2 when it is not subjected to an external force. When the prong 11 is unplugged manually, the positioning portion 14 can be disengaged from the positioning groove 15 based on the certain deformability of the prong 11 itself, so that the center tube core 1 can be pulled out and replaced.

In some embodiments, the positioning portion 14 includes a plurality of positioning protrusions arranged at intervals or an annular positioning rib, and the number of the protrusions is at least two so as to achieve a multi-point positioning, so that the connection between the prong 11 and the base 2 is stable. Correspondingly, the positioning groove 15 is an annular groove, which is suitable for the installation of protrusions or positioning rib. Positioning protrusions are more preferred, which not only meet the connection and fixing requirements, but also prevent excessive local deformation of the prong 11 in the plugging and unplugging operation.

Figure 9:
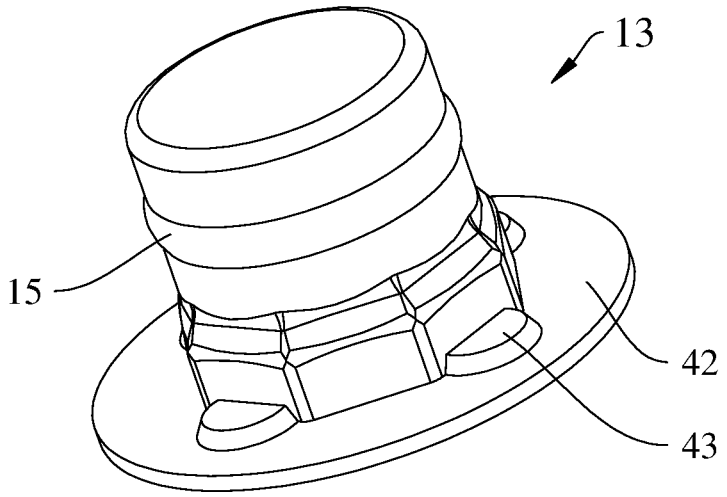
FIG. 9 is a perspective view of a connecting seat according to an embodiment.
Figure 10:
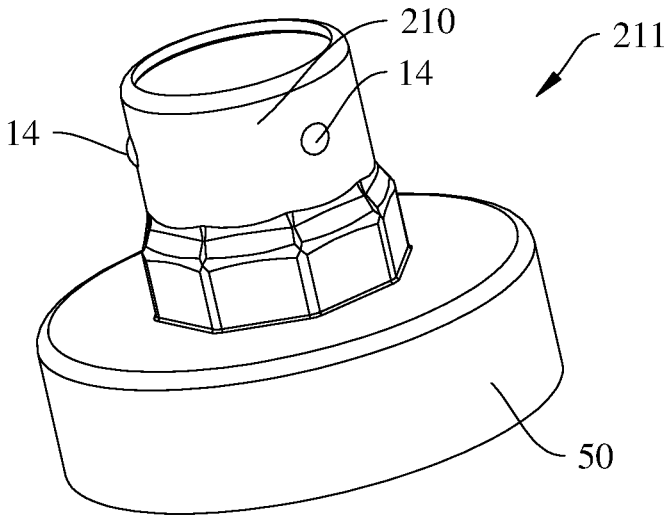
FIG. 10 is a perspective view of a fixing plate according to an embodiment.

As shown in FIGS. 9 and 10, in some embodiments, the positioning portion 14 is protruded from the outer wall of the plug 210, and the positioning groove 15 is defined in the inner wall of the socket 110.

The positioning portion 14 extends toward the outside, which is convenient for punching. In this embodiment, the inner wall of the socket 110 is the inner wall of the connecting seat 13. The connecting seat 13 is a thin metal sheet with a certain deformation capacity. When the connecting seat 13 is installed vertically downward, it deforms itself so that the positioning groove 15 is surrounded around the positioning portion 14. Further, the prong 11 and the connecting seat 13 are fixed to each other by bonding or welding, so as to realize the connection between the prong 11 and the base 2.

As shown in FIGS. 11 to 17, in another embodiment, the base 2 includes an outer base 20 and an inner base 21 located in the outer base 20, the inner base 21 includes a fixing plate 211 and a columnar portion protruding axially from the middle of the fixing plate 211, and the columnar portion is used as the plug 210. The edge of the fixing plate 211 extends axially to form a skirt 50 surrounding the outer periphery of the prong 11, the positioning portion 14 is located inside the skirt 50, and the positioning groove 15 is opened in the outer wall of the prong 11.

As shown in FIGS. 13 to 17, the skirt 50 is formed by punching and can include multiple portions arranged at intervals or extend continuously. The positioning portions 14 are configured as positioning protrusions, and are arranged at intervals on the inner wall of the skirt 50, and correspondingly, the positioning groove 15 is defined in the prong 11 in a ring shape. The fixing plate 211 is fixed on the outer base 20 by gluing, and the center tube core 1 and the base 2 are fixed together through the engagement of the positioning portion 14 and the positioning groove 15 of the prong 11.

Figure 17:
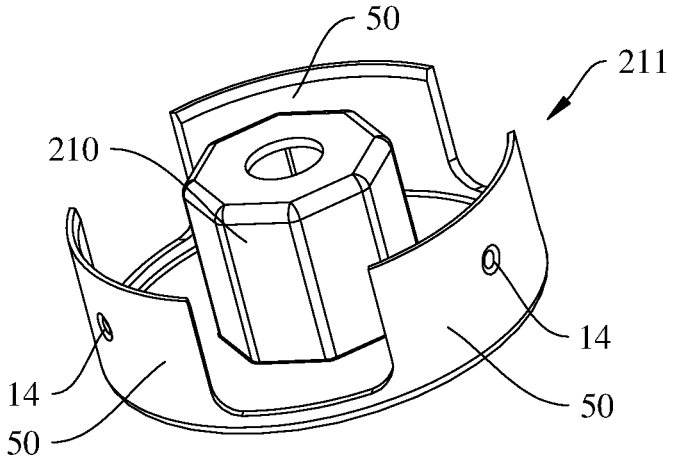
FIG. 17 is a perspective view of a fixing plate according to an embodiment.

As shown in FIG. 17, in a preferred embodiment, the skirt 50 includes a plurality of unit sheets arranged at intervals along the circumferential direction, at least two unit sheets are provided with positioning portions 14, and there are at least three unit sheets arranged at uniform intervals to realize a triangular positioning and a stale guiding for the prong 11. The unit sheets are discontinuously arranged, so that the fixing plate 211 has a good deformation capacity, which facilitates the plugging and unplugging of the prong 11. Positioning portions 14 are provided on at least two unit sheets, so as to improve the connection stability of the prong 11 with the base 2.

As shown in FIG. 2, and FIG. 6 to FIG. 9, in some embodiments, the prong 11 has a bottom opening 40, and the bottom opening 40 has an inner flange 41, and the connecting seat 13 includes an annular portion 42 overlapped with the inner flange 41, and a receiving sleeve 111 extending axially from the inner edge of the annular portion 42 into the bottom opening 40, wherein the interior of the receiving sleeve 111 is the socket 110.

The bottom opening 40 is defined by the outer peripheral edge of the inner flange 41, which is formed by punching, and the inner flange 41 is perpendicular to the axial direction. The annular portion 42 supports the prong 11 against the inner flange 41, and the inner flange 41 is glued or welded on the annular portion 42, so that the connecting seat 13 and the prong 11 are fixedly connected to each other. The receiving sleeve 111 is formed by punching, and the outer peripheral surface thereof close to the annular portion 42 fits the outer peripheral edge of the inner flange 41 to limit the circumferential movement of the prong 11.

As shown in FIGS. 2 and 6 to 9, in some embodiments, the annular portion 42 has an axial undulating structure, and the base 2 and the prong 11 are abutted and pre-tensioned with each other through the undulating structure. The undulating structure is a protrusion extending from the surface of the annular portion 42 along the axial direction for abutting against the prong 11, and the protrusion can be a continuous ring or a plurality of protrusions can be arranged at intervals. The protrusion abuts against the prong 11, and the other part of the annular portion 42 (except the protrusion) abuts against the base 2.

As shown in FIG. 9, in a preferred embodiment, the undulating structure is formed by a plurality of bulges 43 arranged at intervals. In the axial direction, the bulges 43 rise in the same direction and face the prong 11.

At least three bulges 43 are provided for abutting against the prong 11, and the heights of the bulges 43 are the same to ensure the horizontal arrangement of the prong 11.

In some embodiments, the plurality of bulges 43 are evenly distributed along the axial direction, and are located adjacent to the receiving sleeve 111 in the radial direction. If the bulges 43 are all arranged in a semicircular area, the prong 11 will not be supported stably. Therefore, the uniform arrangement of the bulges 43 makes the prong 11 be supported more stable. Further, it is convenient for punching by designing the bulges 43 adjacent to the receiving sleeve 111.

As shown in FIG. 18, in another embodiment, the prong 11 and the base 2 are magnetically engaged to restrict the axial movement relative to each other.

One of the prong 11 or the base 2 is provided with a magnet, and the other has magnetism (for example, it is made of magnetic powder or metal with magnetism). Without an external force, the center tube core 1 can be prevented from falling out of the base 2 based on the magnetic attraction. When the center tube core 1 needs to be replaced, the center tube core 1 can be manually pulled out.

As shown in FIG. 18, in some embodiments, the base 2 includes an outer base 20 and an inner base 21 located in the outer base 20. The inner base 21 includes a fixing plate 211 and a columnar portion protruding axially from the middle of the fixing plate 211, and the columnar portion is used as the plug 210. A first attracting member 60 is clamped and fixed between the outer base 20 and the inner base 21, and a second attracting member 61 magnetically attracted to the first attracting member 60 is fixed on the prong 11.

The first attracting member 60 is a cylindrical magnet and fixed between the outer base 20 and the inner base 21 by gluing or other methods. The second attracting member 61 is magnetic (it can be a magnet or of a material which has magnetism itself), and arranged at the bottom of the prong 11 to facilitate the attraction with the first attracting member 60 with each other. The second attracting member 61 can be formed by punching the prong 11 or connected to the bottom of the prong 11 as a separate piece by bonding or other connection methods, and the prong 11 can be made of non-magnetic metal material, such as aluminum.

Figure 20:
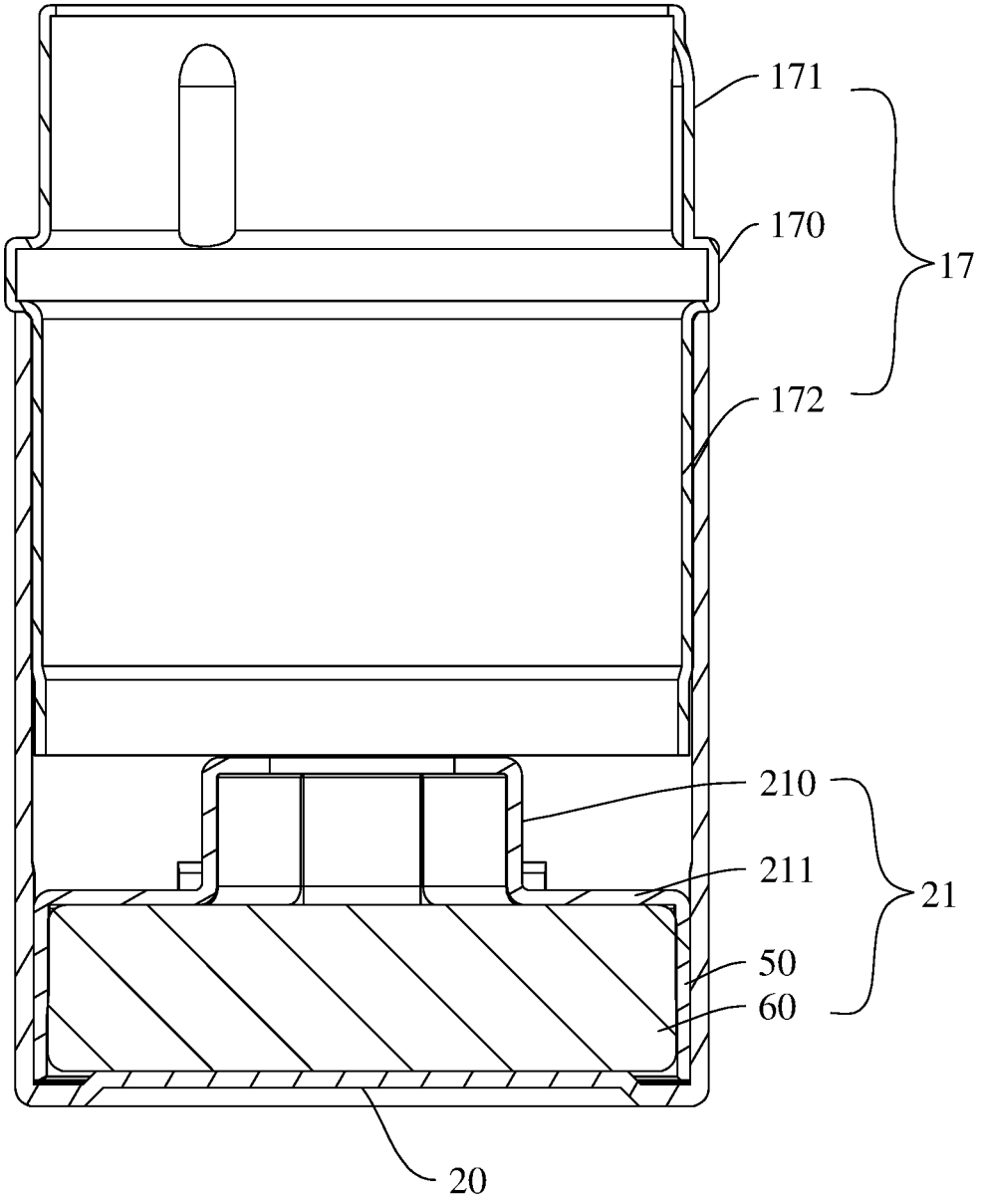
FIG. 20 is a structural schematic view of a base according to an embodiment.
Figure 21:
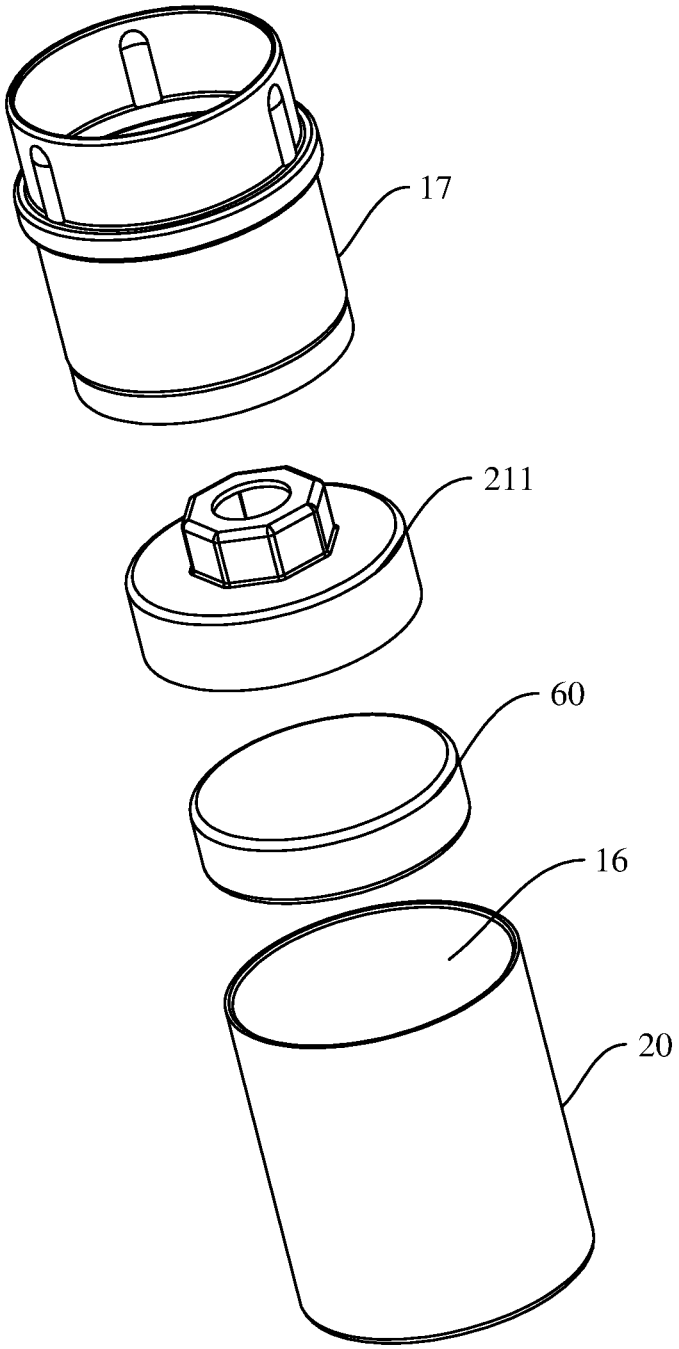
FIG. 21 is an exploded view of a base according to an embodiment.
Figure 22:
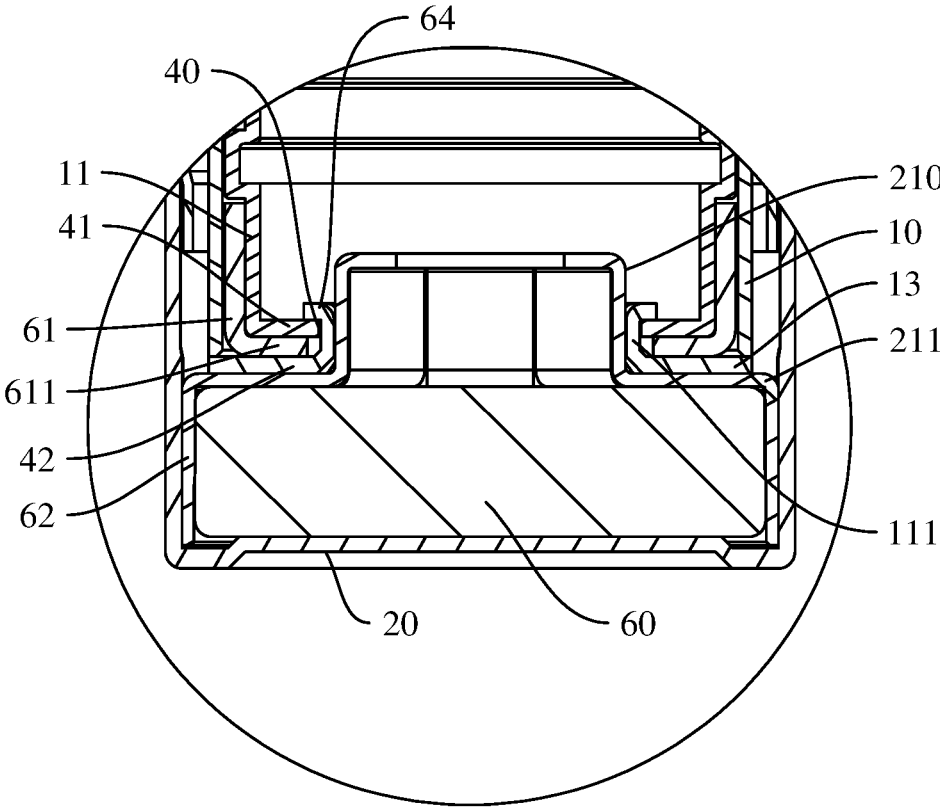
FIG. 22 is an enlarged view of part A in FIG. 18.

As shown in FIGS. 20 to 22, in some embodiments, the outer peripheral edge of the fixing plate 211 has a flange 62 facing away from the prong 11, and the first attracting member 60 is enclosed in the flange 62. The first attracting member 60 is cylindrical and fits with the inner wall of the outer base 20 in clearance. The flange 62 is formed by punching and inserted into the gap between the outer base 20 and the first attracting member 60 to clamp the first attracting member 60, the outer base 20, the first attracting member 60 and the fixing plate 211 are connected with each other by gluing.

In some embodiments, the second attracting member 61 is shaped as a ring and fixed around the outer periphery of the prong 11. The ring surrounds the outer periphery of the prong 11, so that it can be better fixedly connected with the prong 11, and the ring-shaped structure makes the second attracting member 61 and the first attracting member 60 are more tightly attracted to each other, effectively preventing the prong 11 from accidentally falling off.

As shown in FIGS. 18 to 24, in some embodiments, the prong 11 has a bottom opening 40, and the bottom opening 40 has an inner flange 41, and the connecting seat 13 includes an annular portion 42 overlapped with the inner flange 41, and a receiving sleeve 111 extending axially from the inner edge of the annular portion 42 into the bottom opening 40, wherein the interior of the receiving sleeve 111 is the socket 110. The bottom of the second attracting member 61 is provided with an inwardly folded portion 611, which is fixedly clamped between the inner flange 41 and the annular portion 42.

The inner flange 41 is shaped as a circular ring formed by punching, and its inner periphery defines the bottom opening 40. The shape of the bottom opening 40 is adapted to the shape of the outer periphery of the receiving sleeve 111. The annular portion 42 is an annular disc, which abuts against the bottom surface of the inwardly folded portion 611. The inwardly folded portion 611 has a circular ring shape formed by punching, and extends radially inward along the bottom edge of the second attracting member 61. The inner peripheral edge of the inwardly folded portion 611 defines an opening, and the opening of the inwardly folded portion 611 has the same size as or slightly larger than the bottom opening 40. When installing, the second attracting member 61 and the prong 11 are inserted around the receiving sleeve 111 in sequence, and the second attracting member 61 and the prong 11 are prevented from playing circumferentially through the engagement of the inwardly folded portion 611 and the bottom opening 40 with the receiving sleeve 111, respectively. Moreover, the connecting seat 13, the second attracting member 61 and the prong 11 can be fixed as a whole by gluing, so that the center tube core 1 can be plugged and unplugged as a whole.

Figure 23:
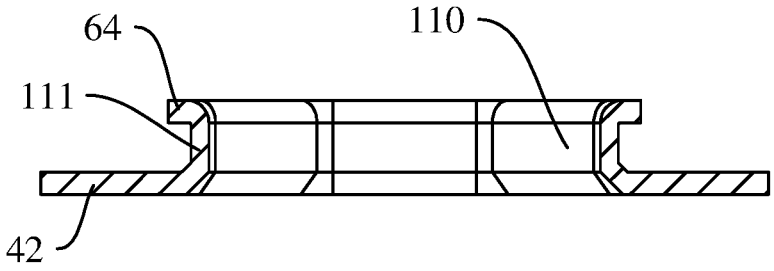
FIG. 23 is a cross-sectional view of a connecting seat according to an embodiment.
Figure 24:
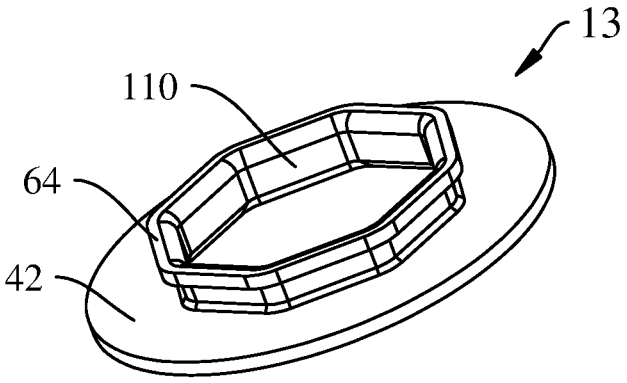
FIG. 24 is a perspective view of a connecting seat according to an embodiment.

As shown in FIGS. 22 to 24, in some embodiments, the top edge of the receiving sleeve 111 is folded to form an inner edge 64 that wraps around the inner flange 41, and the inner edge 64 needs to be formed by punching after the second attracting member 61 and the prong 11 are installed. The inner edge 64 and the annular portion 42 clamp and fix the second attracting member 61 and the prong 11, preventing the second attracting member 61 and the prong 11 from moving in the axial direction. Furthermore, since the connecting seat 13, the second attracting member 61 and prong 11 are relatively fixed as a whole, a process of gluing is omitted.

As shown in FIG. 18 and FIG. 22, in some embodiments, the bottom of the spiral 10 covers the outer periphery of the second attracting member 61, so that when the center tube core 1 is pulled out, the second attracting member 61 is hidden and difficult to be noticed, with a more concise product appearance.

As shown in FIGS. 18 and 22, in some embodiments, the bottom edge of the spiral 10 abuts against the annular portion 42. The annular portion 42, the spiral 10 and the prong 11 surround the second attracting member 61 and cover the second attracting member 61 from various angles, making the appearance of the center tube core 1 more concise and preventing the second attracting member 61 from falling out.

Figure 5:
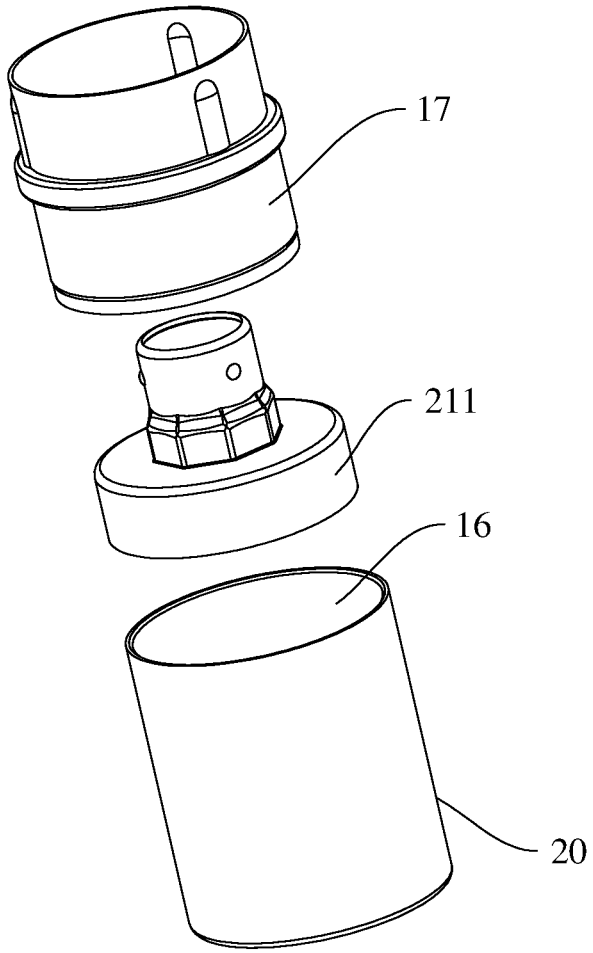
FIG. 5 is an exploded view of a base according to an embodiment.
Figure 6:
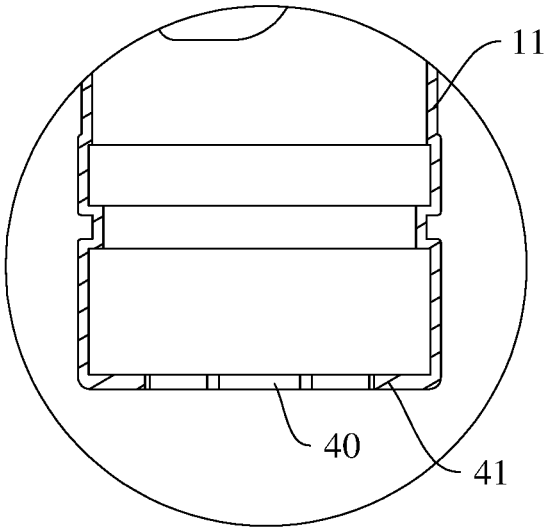
FIG. 6 is a partial sectional view of a prong of the packaging tube in FIG. 2.
Figure 14:
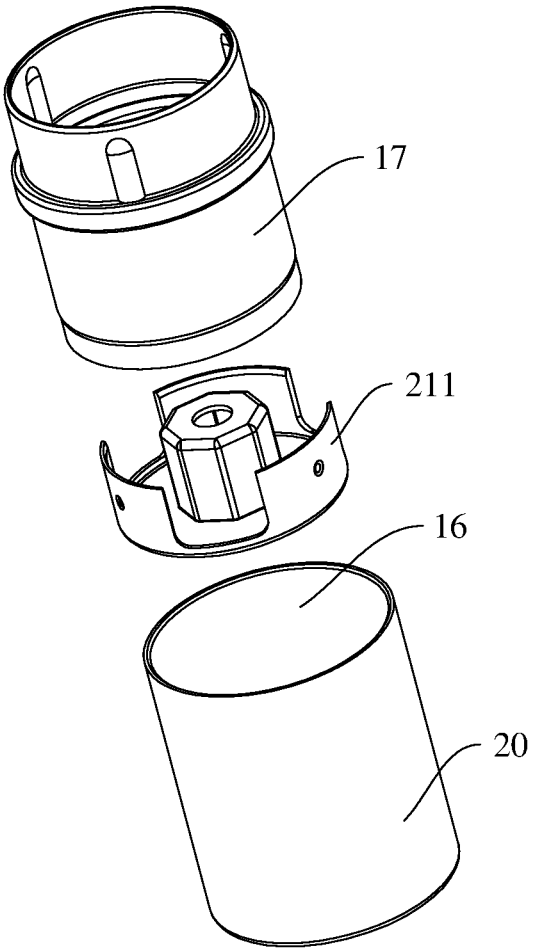
FIG. 14 is an exploded view of a base according to an embodiment.
Figure 15:
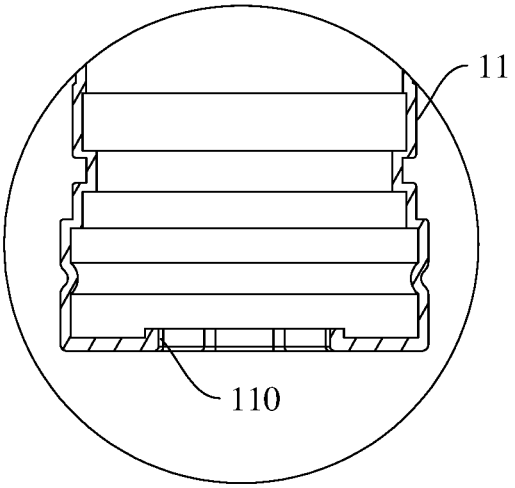
FIG. 15 is a partial sectional view of a prong according to an embodiment.

As shown in FIG. 5, FIG. 14 and FIG. 21, in some embodiments, the outer base 20 has a cylindrical structure, one end of which is closed or contracted, and the other end has a receiving opening 16 for the center tube core 1 to be plugged therein. The closed or contracted end of the outer base 20 is far away from the center tube core 1 to protect the internal structure (dustproof and antifouling). The inner wall of the receiving opening 16 is adapted to the outer wall of the center tube core 1 to limit the circumferential movement of the center tube core 1.

As shown in FIG. 2, FIG. 4, FIG. 11, FIG. 13, FIG. 18 and FIG. 20, in some embodiments, the base 2 further includes a sleeve 17 fixedly inserted into the receiving opening 16, and the outer periphery of the sleeve 17 has an annular positioning shoulder 170. One axial side of the positioning shoulder 170 abuts against the top edge of the receiving opening 16, and the other axial side of the positioning shoulder is located outside the base and serves as a connecting portion 171.

The sleeve 17 is cylindrical and formed by punching, and is used to reduce the assembly gap between the base 2 and the center tube core 1, making the appearance more concise. The side of the positioning shoulder 170 close to the receiving opening 16 is located inside the base 2 as an extending portion 172. The extending portion 172 is cylindrical, located between the center tube core 1 and the receiving opening 16, and fixed to the receiving opening 16 by gluing. The positioning shoulder 170 protrudes outwards and abuts against the top edge of the receiving opening 16 to cover the assembly gap. The connecting portion 171 is cylindrical and close to the outer wall of the center tube core 1, so as to reduce the assembly gap between the base 2 and the center tube core 1.

As shown in FIG. 1, in some embodiments, the packaging tube further includes a cover 3 that is movably inserted into the connecting portion 171, and the cover 3 and the base 2 surround and enclose the center tube core 1. The cover 3 is cylindrical, and its inner wall and the outer wall of the connecting portion 171 fit together and guide one another, facilitating the snapping operation. The top of the cover 3 is closed or contracted, and the cover 3 and the base 2 are fitted with each other to cover and enclose the center tube core 1 for dust and dirt prevention. Moreover, the cover 3 and the base 2 are made of metal, which has sufficient strength and improved impact resistance. Compared with plastic materials, cracks are less likely to occur at the connection with the sleeve 17, with a long service life.

The prong 11 and the bead 12 can be fitted with each other using the prior art, which is not the invention focus of the invention. For example, as shown in FIG. 2, FIG. 3, FIG. 11, FIG. 12, FIG. 18 and FIG. 19, in some embodiments, the side wall of the prong 11 is provided with a slideway 112 extending in the axial direction, and the bead 12 has a guiding portion 120 passing through the slideway 112 in the radial direction and engaged with the threaded structure 100.

The slideway 112 is defined in the side wall of the prong 11 along the axial direction, and the guiding portion 120 radially protrudes out of the slideway 112, so that two sides of the slideway 112 can limit the rotation of the bead 12, and thus the bead 12 can only move along the slideway 112 in the axial direction. When the spiral 10 rotates relative to the prong 11, the threaded structure 100 drives the bead 12 to slide axially through the slideway 112. The threaded structure 100 is generally configured as spiral groove, and one or more spiral grooves parallel to each other can be defined. Preferably, there are at least two spiral grooves spaced apart from each other at uniformly intervals, and the slideway 112 and the guiding portion 120 are provided relative to the spiral grooves so that the bead 12 can be driven from multiple angles simultaneously, making the movement of the paste back and forth more stable and smooth. Moreover, since the spiral 10, the prong 11 and the bead 12 are all made of metal, the guiding portion 120 and the threaded structure 100 engaged with each other involve a more stable movement and long service life, avoiding abnormal movement of the paste back and forth.

As shown in FIG. 2, FIG. 3, FIG. 11, FIG. 12, FIG. 18 and FIG. 19, in some embodiments, the two ends of the slideway 112 have a recessed positioning area 113, and when the bead 12 slides to the limit position, the guiding portions 120 are respectively located in the positioning areas 113 at the corresponding ends. The positioning area 113 are defined in the outer wall of the prong 11 and located at the upper and lower ends of the slideway 112. The positioning area 113 extends along the circumferential direction of the prong 11 and allows the bead 12 to stay in the highest and lowest positions.

The packaging tube of the present application is entirely made of metal, and has improved fitting stability based on the unique structural strength of the metal itself. For example, even though the cover 3 and the base 2 are snapped frequently for a long time, cracks are less likely to occur. The times of moving the bead 12 back and forth are increased compared with plastic materials, with an improved user experience for the packaging tube.

The features described in the above various embodiments may be combined. In order to simplify the descriptions, not all possible combinations of the features in the above embodiments have been described. However, any combinations of the features should be within the scope of the invention as long as no conflict resides between these features. In the case where the features in different embodiments are shown in the same drawing, it may be considered that this drawing discloses a combination of the various embodiments involved.

The above embodiments are only several implementations of the present invention which are described specifically and in detail, without limitation to the scope claimed by the present invention. Those skilled in the art can make various modifications and variations to the embodiments without departing from the spirit and scope of the present invention, and these modifications and variations should fall into the scope claimed by the present invention. Therefore, the scope of protection of the invention patent should be subject to the attached claims.

The invention claimed is:

1. A packaging tube, comprising a center tube core and a base, wherein the center tube core and the base are both made of metal, the center tube core has an axial direction and comprises a bead, a prong and a spiral arranged from interior to exterior in sequence, and wherein an inner wall of the spiral has a threaded structure which is configured to drive the bead to slide axially relative to the prong when the spiral rotates relative to the prong, and fitting structures that are pluggable one another in the axial direction are provided between the prong and the base for limiting relative movement between the prong and the base in the axial direction and a circumferential direction;

wherein a bottom of the prong is provided with a socket, or the bottom of the prong is fixed with a connecting seat having the socket, and the base is provided with a plug fitting with the socket; and both the socket and the plug, at least locally, have a non-circular cross-sectional shape to limit circumferential movement therebetween;

the base comprises an outer base and an inner base located within the outer base, and wherein the inner base comprises a fixing plate and a columnar portion protruding axially from middle of the fixing plate and used as the plug; and the columnar portion is formed by punching the fixing plate and a closed plane is formed at a top thereof to improve the structural strength of the plug.

2. The packaging tube according to claim 1, wherein the plug has a non-circular cross-sectional shape only at a portion adjacent to the fixing plate.

3. The packaging tube according to claim 1, wherein one of the prong and the base has a radially extending positioning portion, and the other has a positioning groove for receiving the positioning portion, and wherein the prong and the base restrict axial movement relative to each other through the positioning portion and the positioning groove that cooperate with each other.

4. The packaging tube according to claim 3, wherein the positioning portion includes a plurality of positioning protrusions arranged at intervals or an annular positioning rib.

5. The packaging tube according to claim 4, wherein the positioning portion protrudes outside an outer wall of the plug, and the positioning groove is opened in an inner wall of the socket.

6. The packaging tube according to claim 4, wherein an edge portion of the fixing plate extends axially to form a skirt surrounding an outer periphery of the prong, wherein the positioning portion is located inside the skirt, and the positioning groove is opened in an outer wall of the prong.

7. The packaging tube according to claim 1, wherein the prong has a bottom opening which has an inner flange, and the connecting seat includes an annular portion overlapping the inner flange and a receiving sleeve extending axially from an inner edge of the annular portion into the bottom opening, and wherein an interior of the receiving sleeve is the socket.

8. The packaging tube according to claim 7, wherein the annular portion has an axial undulating structure, and the base and the prong are abutted and pre-tensioned with each other through the undulating structure.

9. The packaging tube according to claim 8, wherein the undulating structure includes a plurality of bulges arranged at intervals, and in the axial direction, the bulges protrude in the same direction and face the prong.

10. The packaging tube according to claim 9, wherein the bulges are evenly distributed along the axial direction, and are positioned adjacent to the socket in a radial direction.

11. The packaging tube according to claim 1, wherein the prong and the base are magnetically engaged to restrict mutual axial movement.

12. The packaging tube according to claim 1, wherein a first attracting member is clamped and fixed between the outer base and the inner base, and a second attracting member magnetically attracted to the first attracting member is fixed on the prong.

13. The packaging tube according to claim 12, wherein an outer peripheral edge of the fixing plate has a flange facing away from the prong, and the first attracting member is enclosed in the flange.

14. The packaging tube according to claim 12, wherein the second attracting member is ring-shaped and fixed around an outer periphery of the prong.

15. The packaging tube according to claim 14, wherein the prong has a bottom opening which has an inner flange, and the connecting seat includes an annular portion overlapping the inner flange and a receiving sleeve extending axially from an inner edge of the annular portion into the bottom opening, and wherein an interior of the receiving sleeve is the socket; and a bottom of the second attracting member is provided with an inwardly folded portion, and the inwardly folded portion is fixedly clamped between the inner flange and the annular portion.

16. The packaging tube according to claim 15, wherein a top edge of the receiving sleeve is rolled up and wraps an inner edge of the inner flange.

17. The packaging tube according to claim 16, wherein a bottom of the spiral covers an outer periphery of the second attracting member.

18. The packaging tube according to claim 17, wherein a bottom edge of the spiral abuts the annular portion; and the annular portion, the spiral and the prong enclose the second attracting member.

19. A packaging tube, comprising a center tube core and a base, wherein the center tube core and the base are both made of metal, the center tube core has an axial direction and comprises a bead, a prong and a spiral arranged from interior to exterior in sequence, an inner wall of the spiral has a threaded structure which is configured to drive the bead to slide axially relative to the prong when the spiral rotates relative to the prong, and fitting structures that are pluggable one another in the axial direction are provided between the prong and the base for limiting relative movement between the prong and the base in the axial direction and a circumferential direction;

a bottom of the prong is provided with a socket, or the bottom of the prong is fixed with a connecting seat having the socket, and the base is provided with a plug fitting with the socket; and both the socket and the plug, at least locally, have a non-circular cross-sectional shape to limit circumferential movement therebetween; and the base comprises an outer base and an inner base located within the outer base, and the inner base comprises a fixing plate and a columnar portion protruding axially from middle of the fixing plate and used as the plug; and a first attracting member is clamped and fixed between the outer base and the inner base, and a second attracting member magnetically attracted to the first attracting member is fixed on the prong.

20. A packaging tube, comprising a center tube core and a base, wherein the center tube core and the base are both made of metal, the center tube core has an axial direction and comprises a bead, a prong and a spiral arranged from interior to exterior in sequence;

an inner wall of the spiral has a threaded structure which is configured to drive the bead to slide axially relative to the prong when the spiral rotates relative to the prong, and fitting structures that are pluggable one another in the axial direction are provided between the prong and the base for limiting relative movement between the prong and the base in the axial direction and a circumferential direction;

a bottom of the prong is provided with a socket, or the bottom of the prong is fixed with a connecting seat having the socket, and the base is provided with a plug fitting with the socket; and both the socket and the plug, at least locally, have a non-circular cross-sectional shape to limit circumferential movement therebetween; and the base comprises an outer base and an inner base located within the outer base, the inner base comprises a fixing plate and a columnar portion protruding axially from middle of the fixing plate and used as the plug; and an edge portion of the fixing plate extends axially to form a skirt surrounding an outer periphery of the prong, wherein the positioning portion is located inside the skirt, and the positioning groove is opened in an outer wall of the prong.

* * * * *